US005911320A

United States Patent [19]

Forestelle

[11] Patent Number: 5,911,320

[45] Date of Patent: Jun. 15, 1999

[54] ALTERNATE STACKING PAPER TRAY

[76] Inventor: Lori Forestelle, 33579 S. Adams Rd., Molalla, Oreg. 97038

[21] Appl. No.: 08/867,659

[22] Filed: Jun. 2, 1997

[51] Int. Cl.[6] ..... B65D 85/00

[52] U.S. Cl. ..... 206/215; 206/561; 206/565; 220/4.27; 220/676

[58] Field of Search ..... 206/215, 449, 206/503, 509, 512, 555, 557, 564, 804, 815; 211/10, 11, 50, 126.2, 133.6; 220/4.27, 676; D7/552.2, 553.2; D9/345, 346; D19/92, 100

[56] References Cited

U.S. PATENT DOCUMENTS

| | | | |
|---|---|---|---|
| 465,382 | 12/1891 | Marks | 206/512 |
| 1,235,115 | 7/1917 | Coppage | 220/62 |
| 1,740,424 | 12/1929 | Blaine | 206/449 |
| 1,867,738 | 7/1932 | Fraser | 206/449 |
| 2,100,720 | 11/1937 | Page | 206/449 |
| 4,167,232 | 9/1979 | Munk et al. | 206/509 |
| 5,005,709 | 4/1991 | Stokes | 211/50 |

*Primary Examiner*—Allan N. Shoap
*Assistant Examiner*—Joe Merek

[57] ABSTRACT

An alternate stacking paper tray has a planar base with a first edge, a second edge, a third edge positioned opposite the first edge and a fourth edge positioned opposite the second edge. A side is disposed upwardly from each edge. Paper guiding walls are disposed from each side to define a first paper receiving area and a second paper channel which intersects the first paper receiving area. In a preferred embodiment the paper guiding walls extend outwardly to meet the closest adjacent paper guiding wall, thus forming compartments positioned at the corners of the base.

6 Claims, 1 Drawing Sheet

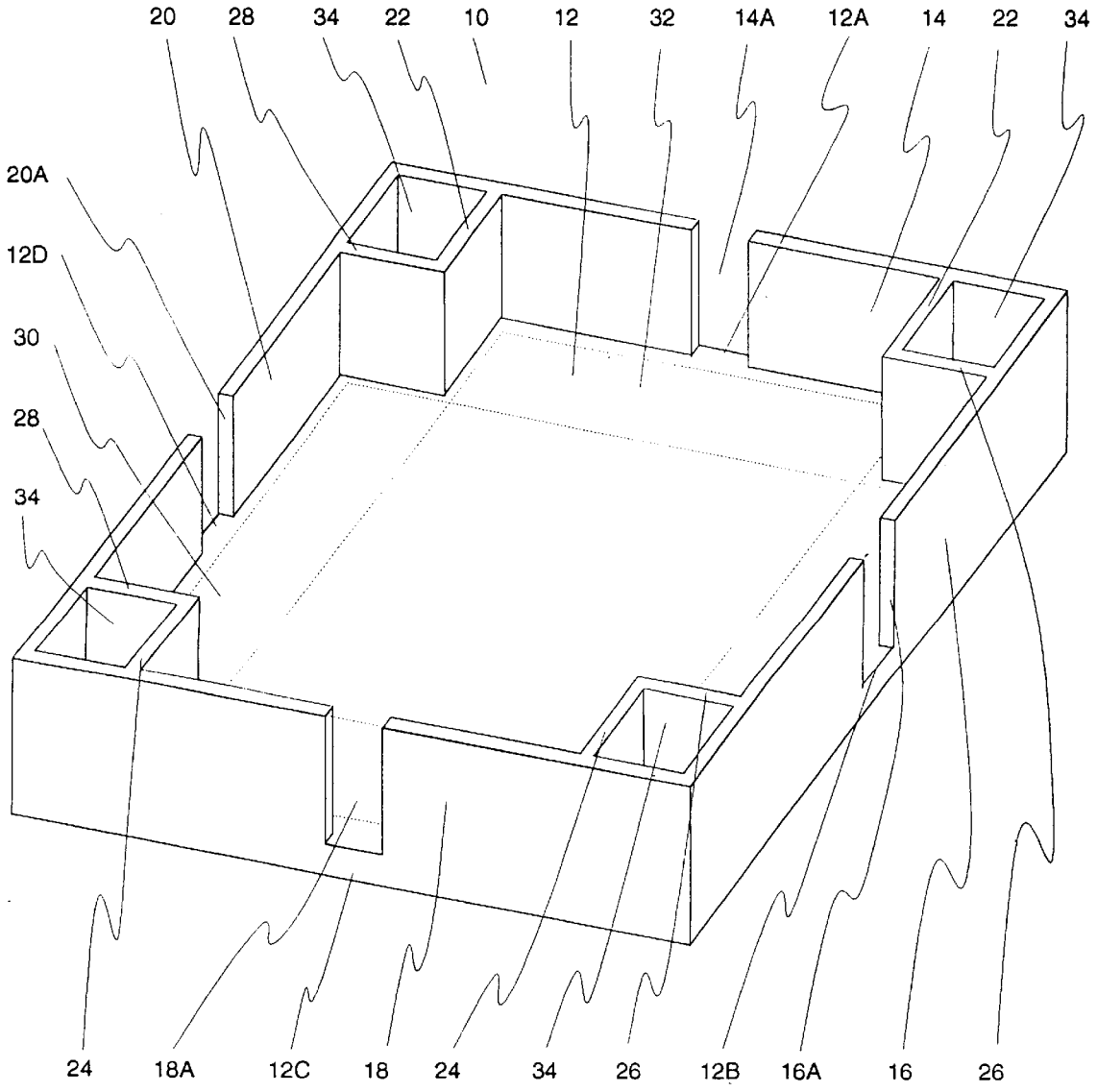
20
28
34
22
10
12
32
14A
12A
14
22
34
20A
12D
30
28
34
24
18A
12C
18
24
34
26
12B
16A
16
26

ALTERNATE STACKING PAPER TRAY

BACKGROUND—FIELD OF INVENTION

This invention relates to paper trays, particularly to a paper tray which holds uncollated papers securely.

BACKGROUND—DESCRIPTION OF PRIOR ART

Every person who has ever tried to produce, copy, collate and bind a document of many pages knows the difficulty of keeping all this paper in order and in a pristine condition prior to actual collation. These projects often take days and weeks to complete and copies of each page are usually stacked one on top of the other until collation. These stacks are subject to falling, becoming dirty and take up space not readily available in a small or home office. Pages are seldom created in the final sequence of the completed document. From the time the first pages are produced they must be kept clean and unwrinkled, with like pages remaining together.

This task is relatively easy if a state-of-the-art copier and collator is available, but most small offices do not contain such advanced equipment. There are collating devices which hold the various pages separately and, if room allows, the completed pages can be stored there. However, these devices offer no protection from sliding off a desk or falling out of the collating sections. Some devices exist which protect papers, but they are bulky and cannot be used for many-paged documents without utilizing many devices because each device only enables the assembly of eight to ten pages.

Many of the current devices take up large amounts of space. Effective use of office space is a major concern when space is either scarce, expensive, or both. A device may only provide space for twenty page collation when what is actually needed is spacers to collate fifty copies of six pages. In addition, the stored pages often need to be moved to a larger space for actual collation. This movement creates another opportunity for the papers to be dropped or to slide, thereby changing their order and allowing them to become damaged.

What is needed is a small, inexpensive portable device to store paper, maintain the pristine condition of the paper, and facilitate collation of various volumes.

SUMMARY

An alternate stacking paper tray has a planar base with a first edge, a second edge, a third edge positioned opposite the first edge and a fourth edge positioned opposite the second edge. A side is disposed upwardly from each edge. Paper guiding walls are disposed from each side to define a first paper channel and a second paper receiving area which intersects the first paper receiving area. In a preferred embodiment the paper guiding walls extend outwardly to meet the closest adjacent paper guiding wall, thus forming compartments positioned at the corners of the base. The paper receiving areas may be dimensioned to accommodate various sizes of paper including 8½ inches by 11 inches and 8½ inches by 14 inches.

The alternate stacking paper tray allows different groups of papers, such as uncollated multi paged documents to be stored in an orderly and safe manner in a very small amount of space. It is inexpensive and suited to the various needs of a small or home office but it could also be useful in any office setting.

An advantage of this design is its adaptability to fit whatever document is being prepared. Any number of pages or any number of copies will fit into the unit up to its capacity. Each storage separation is determined by the user who simply inserts identical paper into the tray in the identical direction, changing paper direction with content. This system allows also for partial collation separation, i.e. if the first half of a document is complete, the copyist may be assembled and stored in the paper tray in its partially collated condition and further pages may be separately stored on top of them.

One further advantage is that the paper tray may be manufactured in various sizes to accommodate standard or legal sized paper. Another advantage is that the corners of the tray are designed so as to store paper clips or other small office supply items.

BRIEF DESCRIPTION OF DRAWINGS

The FIGURE is a perspective view of the alternate stacking paper tray.

DETAILED DESCRIPTION OF THE PREFERRED EMBODIMENT

The FIGURE shows a perspective view of the alternate stacking paper tray 10. The paper tray 10 includes a base 12 which has edges 12A, 12B, 12C, and 12D. First side 14 is disposed upwardly from edge 12A, second side 16 is disposed upwardly from edge 12B, third side 18 is disposed upwardly from edge 12C, and fourth side 20 is disposed upwardly from edge 12D. A first pair of paper guiding walls 22 extend inwardly from first side 14. Walls 22 are spaced apart to conform with the width of a standard piece of paper. A second pair of paper guiding walls 24 extend inwardly from third side 18 and align with walls 22. Thus first side 14, third side 18, walls 22 and walls 24 define a paper receiving area (shown holding paper 32). Similarly, a third pair of paper guiding walls 26 extend inwardly from second wall 16 and a fourth pair of paper guiding walls 28 extend inwardly from fourth side 20. Walls 26 and walls 28 align to form a second paper receiving area (shown holding paper 30) which intersects the first paper receiving area. Each paper guiding wall 22, 24, 26, and 28 is shown extending inwardly until it intersects with the nearest wall from an adjacent side to form compartments 34.

First side 14 includes a vertical first side slot 14A of sufficient width to permit the insertion of fingers into the tray 10 to easily separate and grasp layers of paper held within the first receiving area. Similarly, second side 16 includes vertical second side slot 16A, third side 18 includes vertical third side slot 18A, and fourth side 20 includes vertical fourth side slot 20A.

The above description is directed to the preferred embodiment of the present invention. Several variations are possible. Accordingly, the scope of the invention should be determined not by the embodiment illustrated, but by the appended claims and their legal equivalents.

The invention claimed is:

1. A paper storage tray comprising:

a substantially planar base having a first edge, a second edge, a third edge positioned opposite the first edge, and a fourth edge positioned opposite the second edge; a first side disposed upwardly from the first edge, a second side disposed upwardly from the second edge, a third side disposed upwardly from the third edge, and a fourth side disposed upwardly from the fourth edge; said first and third sides are parallel and said second and fourth sides are parallel, and said first and third sides are between said second and fourth sides;

a first pair of paper guiding walls disposed inwardly from the first side, a second pair of paper guiding walls disposed inwardly from the third side, whereby the first and second pairs of paper guiding walls define a first paper receiving area;

a third pair of paper guiding walls disposed inwardly from the second side; and a fourth pair of paper guiding walls disposed inwardly from the fourth side, wherein the third and fourth pairs of paper guiding walls define a second paper receiving area, the second paper receiving area intersecting with the first paper receiving area, wherein each paper guide wall extends outwardly at a ninety degree angle from the side from which the respective paper guide wall is disposed to meet the nearest paper guide wall on the next adjacent side thus forming four compartments, each compartment positioned at a corner of the base, each compartment comprising four upstanding side walls, and an open top.

2. A paper storage tray as in claim 1, wherein the first side is structured to include a vertical first side slot positioned between the first pair of paper guiding walls and the second side is structured to include a vertical second side slot positioned between the third pair of paper guiding walls.

3. A paper storage tray as in claim 2, wherein the third side is structured to include a vertical third side slot positioned between the second pair of paper guiding walls and the fourth side is structured to include a vertical fourth side slot positioned between the fourth pair of paper guiding walls.

4. A paper storage tray as in claim 3, wherein the base is square.

5. A paper storage tray as in claim 4, wherein the dimensions of the first and second paper channels are each 8½ inches by 11 inches.

6. A paper storage tray as in claim 4, wherein the dimensions of the first and second paper channels are each 8½ inches by 14 inches.

* * * * *